US005576592A

United States Patent [19]

Koenigsberg et al.

[11] Patent Number: 5,576,592

[45] Date of Patent: Nov. 19, 1996

[54] HIGH INTENSITY DISCHARGE LAMP WITH SUBSTANTIALLY ISOTHERMAL ARC TUBE

[75] Inventors: William D. Koenigsberg, Concord; Michael J. Shea, Salem; Gregory Zaslavsky, Marblehead, all of Mass.

[73] Assignee: Osram Sylvania Inc., Danvers, Mass.

[21] Appl. No.: 563,419

[22] Filed: Nov. 28, 1995

[51] Int. Cl.[6] ..... H01J 1/02; H01J 7/24; H01J 61/52; H01J 17/16

[52] U.S. Cl. ..... 313/25; 313/11; 313/17; 313/634

[58] Field of Search ..... D26/118, 128; 313/11, 17, 25, 634; 362/372

[56] References Cited

U.S. PATENT DOCUMENTS

| | | | |
|---|---|---|---|
| D. 20,680 | 4/1891 | Blair | D26/128 |
| D. 205,372 | 7/1966 | Walz | D26/128 |
| D. 285,123 | 8/1986 | Schwartz | D26/118 |
| 1,063,083 | 5/1913 | McCrone | D26/128 X |
| 4,499,396 | 2/1985 | Fohl et al. | 313/25 |
| 4,580,989 | 4/1986 | Fohl et al. | 445/26 |
| 4,808,876 | 2/1989 | French et al. | 313/25 |
| 4,859,899 | 8/1989 | Keeffe et al. | 313/25 |
| 5,075,588 | 12/1991 | Hunter | 313/25 |
| 5,252,885 | 10/1993 | Muzeroll et al. | 313/25 |
| 5,253,153 | 10/1993 | Mathews et al. | 362/310 |
| 5,424,609 | 6/1995 | Geven et al. | 313/623 |

*Primary Examiner*—Louis M. Arana
*Assistant Examiner*—Mack Haynes
*Attorney, Agent, or Firm*—William H. McNeill

[57] ABSTRACT

In a metal halide arc discharge lamp having a light emitting arc discharge tube surrounded by a heat absorbing, light transmissive shroud hermetically sealed within an outer lamp envelope, more nearly isothermal operation of the arc tube surface is achieved by using a shroud having a geometry (e.g., a hollow frustum of a cone) such that the shroud is closer to the cooler portions of the arc tube than to the hotter portions. At steady state lamp operation, the shroud absorbs heat emitted by the arc tube and radiates a portion of the absorbed heat back to the arc tube. By having a shroud geometry and spacing such that the inner surface of the shroud is closest to the coolest portions of the arc tube and furthest away from the hottest portions of the arc tube, the shroud radiates more heat back to the cooler portions, thereby providing more nearly isothermal operation of the surface of the arc tube than can be accomplished with a coaxial, cylindrical shroud or no shroud.

8 Claims, 5 Drawing Sheets

HIGH INTENSITY DISCHARGE LAMP WITH SUBSTANTIALLY ISOTHERMAL ARC TUBE

FIELD OF THE INVENTION

This invention relates to an arc discharge lamp having means for providing a more nearly isothermal arc tube surface during lamp operation. More particularly, this invention relates to a high intensity, shrouded metal halide arc discharge lamp wherein the distance between the inner wall surface of the shroud and the outer wall surface of the arc tube is not uniform, but varies to radiate more heat back to the cooler portions of the arc tube, thereby providing a more nearly isothermal arc tube surface during lamp operation.

BACKGROUND OF THE INVENTION

High intensity arc discharge lamps, such as metal halide arc discharge lamps, include a light emitting arc discharge tube hermetically sealed within a light transmissive, vitreous lamp envelope. Electrical energy is coupled through a metal lamp base to the arc tube. Metal halide arc tubes provide excellent color, long life and high efficiency. The arc tube is generally cylindrical, having a longitudinal axis and made of fused quartz hermetically sealed at both ends over a pair of opposing electrodes by a pinch or press seal. It contains an ionizable fill sealed within for forming a visible light-emitting arc when the electrodes are energized. The fill contains mercury and a halide of sodium and one or more metals such as scandium, thorium, thallium, praseodymium, neodymium, cesium, cerium, etc., and an inert starting gas such as argon. The arc tube can also be made of a light transmissive ceramic, such as polycrystalline or single crystal alumina as disclosed in U.S. Pat. No. 5,424,609. Metal halide arc discharge lamps frequently incorporate a shroud which provides both performance and safety improvements. The shroud comprises a cylindrical, light transmissive member, such as fused quartz, which is able to withstand the high operating temperatures of the lamp and, at the same time, serve as a containment means to protect the environment external to the lamp from shards of the arc tube in the rare event that one should burst. The arc tube and the shroud are coaxially mounted within the lamp envelope, with the arc tube concentrically positioned within the shroud. Thus, a constant and uniform distance is provided between the inner wall of the shroud and the outer wall of the arc tube.

Arc tube shrouds are disclosed as being open at both ends, open at one end and closed at the other end by a domed configuration, and also capped at both ends by perforated metal caps. The shrouds are also heat conserving means which reduce arc tube heat loss by absorbing heat emitted by the arc tube and reradiating a portion of the absorbed heat back to the tube. This results in a more even temperature distribution over the surface of the arc tube than if the shroud were not present. Such shrouds and methods for mounting them around the arc tube are disclosed in, for example, U.S. Pat. Nos. 4,499,396; 4,580,989; 5,075,588 and 5,252,885, all assigned to the assignee of the present invention. However, even with arc discharge lamps incorporating a shroud, the upper portion of the arc tube is hotter than the lower portion due to gas convection within the tube. Thus, when operated in a vertical position, the bottom of the arc tube is cooler than the top, and when operated in a horizontal position, the bottom portion or side of the arc tube is cooler than the upper portion. Surrounding the arc tube with a cylindrical shroud of the prior art has provided some benefits in reducing the temperature differential between the coldest and hottest portions of the arc tube to a value less than it would be without the shroud as disclosed, for example, in U.S. Pat. No. 4,859,899. High temperature, heat reflecting coatings have also been used on arc tubes to reduce the temperature differential between the hot and cold spots, but the results haven't been as good as shrouded arc tubes. Also, the use of coatings requires significantly greater amounts of expensive getters within the outer envelope of the lamp to getter gasses given off by the coatings at the extremely hot operating temperatures (e.g., 800° C.) of the arc tube.

DISCLOSURE OF THE INVENTION

It is, therefore, an object of the invention to obviate the disadvantages of the prior art.

It is another object of the invention to enhance the operation of arc discharge lamps.

These objects are accomplished, in one aspect of the invention, by a method for providing more nearly isothermal operation of the surface of an arc tube of a high intensity arc discharge lamp containing a light and heat emitting arc discharge tube, wherein the method comprises providing the lamp with means for transmitting heat emitted by the arc discharge tube back to the tube and wherein more of the heat is transmitted back to cooler portions of the tube than to hotter portions. Structurally, this is accomplished by providing a high intensity arc discharge lamp comprising a heat and light emitting arc discharge tube with means for transmitting heat emitted by the arc discharge tube back into the tube and wherein more of the heat is transmitted back to cooler portions of the tube than to hotter portions to provide more nearly isothermal operation of the tube

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
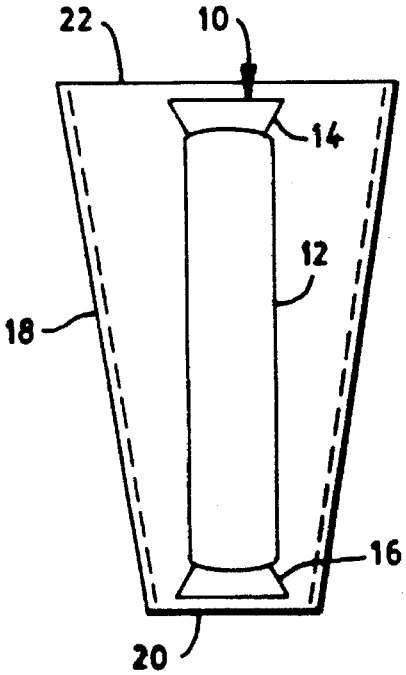
FIGS. 1–4 schematically illustrate embodiments of the invention.
Figure 2:
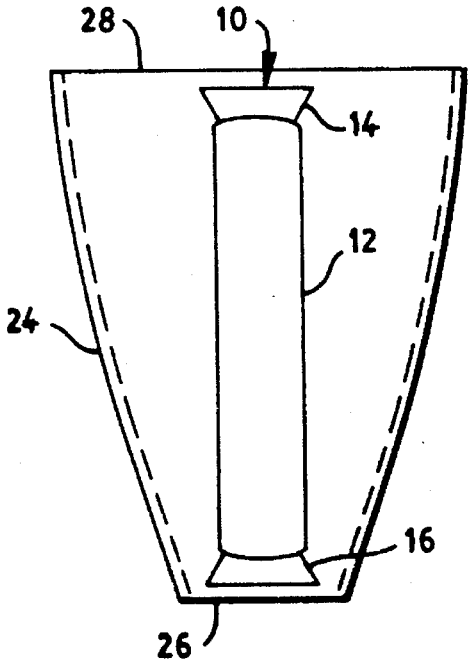

Referring now to the drawings with greater particularity, there is shown in FIG. 1 a schematic illustration of an embodiment of the invention in which an arc tube for a high intensity metal halide lamp is surrounded by a shroud of the invention. Arc tube 10 and shroud 18 are made of high purity fused quartz, such as Type 214 available from GE. Arc tube 10 comprises a cylindrical arc chamber 12 hermetically sealed at the top and bottom by press seals 14 and 16, respectively. The arc tube contains an ionizable fill and an opposing pair of electrodes (not shown) hermetically sealed in the arc chamber for forming a light and heat emitting arc when energized. Hollow fused quartz shroud 18, open at both ends and shaped as a hollow frustum of a cone, is coaxially disposed around the arc tube 10, with its smaller opening 20 disposed around the bottom portion of the arc tube and its larger opening 22 disposed around the upper portion of the arc tube. In operation, the top of the arc tube is hotter than the bottom due to convection of the gas in the tube. However, by having the distance between the inner surface of the shroud closer to the outer surface of the bottom of the arc tube than it is to the outer surface of the top of the arc tube, more of the heat emitted by the arc tube is reradiated by the heat absorbing shroud back to the bottom of the arc tube than to the top. By proper design of the shroud with respect to thickness, conical angle and radial distance from the bottom and top of the arc tube, the shroud reradiates the heat emitted by the arc tube back to the arc tube in a manner as described above, such that the surface of the arc tube operates more nearly isothermally. Similarly, FIG. 2 schematically illustrates another embodiment of the invention in which a hollow, fused quartz shroud 24, shaped as a parabolioid of revolution around a central, longitudinal axis, is coaxially disposed around arc tube 10, with the smaller opening 26 of the shroud disposed around the bottom portion of the arc tube and the larger opening 28 of the shroud disposed around the upper portion of the arc tube. As is the case with the embodiment of FIG. 1, shroud 24 illustrated in FIG. 2 absorbs and reradiates heat emitted by the arc tube back to the arc tube in a manner as described above such that the surface of the arc tube operates more nearly isothermally. Thus, because the inner surface of the shroud is closer to the bottom outer surface of the arc tube than to the top, the hot shroud radiates more heat to the bottom of the arc tube than to the top.

Figure 3:
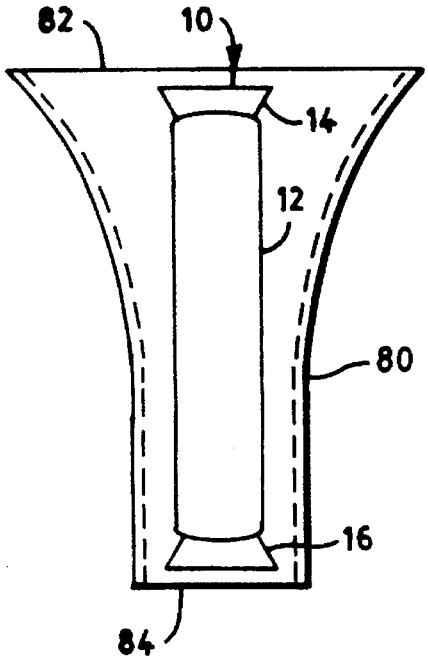

FIG. 3 is a schematic illustration of another embodiment of the invention in which arc tube 10 is coaxially positioned in shroud 80 shaped like an outward flaring bell or horn and open at both ends 82 and 84 and, in which, unlike the previous two embodiments in which the surface curvature is zero or, respectively, the surface curvature is here concave. In this embodiment, the distance between the outer surface of the cylindrical arc tube and the inner surface of the shroud is again smallest at the bottom 84 of the shroud and largest at the top 82. Again, this means that the amount of heat radiated by the hot shroud back to the arc tube surface is greatest at the bottom of the shroud. However, unlike the embodiments above, the initial increase in the distance between the arc tube and shroud surfaces is much less for a given distance up from the bottom of the shroud for more than half the vertical distance up from the bottom. The distance then increases at an ever increasing rate as the top 82 of the shroud is approached.

Figure 4:
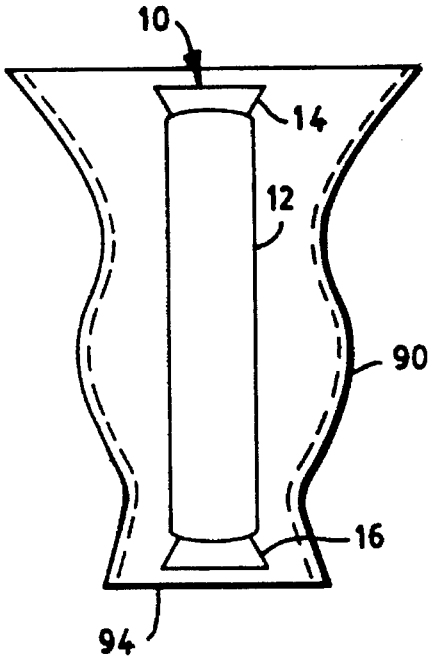

FIG. 4 illustrates another embodiment of the invention in which arc tube 10 is coaxially centered in shroud 90 open at both the top 92 and bottom 94. This shroud has a more complex surface profile, somewhat sinusoidal, combining both concave and convex surfaces. Infrared imaging studies have revealed that the surface temperature of an energized arc tube is not infrequently nonuniform. Thus, even though the bottom of the arc tube is cooler than the top, temperature increase from bottom to top is not uniform or linear in some cases. Further, localized thermal disturbances can produce hot spots in cooler regions and vice versa. The amount and intensity of temperature nonuniformity depends on the arc tube design. In some cases these localized variations will require a more complex shroud shape to produce more nearly isothermal operation. These shapes have to be determined empirically on a case by case basis. FIG. 4 is intended to be merely representative of such a case.

In the four embodiments described above, the longitudinal axes of the arc tubes and shrouds are concentric, with the amount of heat radiated back to the arc tube by the hot shroud being greatest at the bottom of the shroud and diminishing in intensity along the longitudinal axis to the top of the shroud, to achieve a more nearly isothermal operation of the vertical arc tube surface than can be achieved (i) without a shroud and (ii) with a concentric cylindrical shroud of the prior art. In each of these four embodiments the surface of the shroud is geometrically concentric about its longitudinal axis and the shroud cross section perpendicular to that axis is circular. The particular geometry chosen will, of course, depend on the size, shape and wattage of the arc tube, the electrode spacing, etc. and is determined by the practitioner. Further, it will be appreciated that if the arc tube is skewed so as to operate at an angle between vertical and horizontal, the longitudinal axes of the shroud and arc tube may not be coincident. Further, in such skewed operation and in other embodiments the surface of the shroud may not be geometrically concentric about the longitudinal axis and its cross section may not be circular or ring shaped at every point along, and perpendicular to, its longitudinal axis as illustrated in the four embodiments above.

Figure 5:
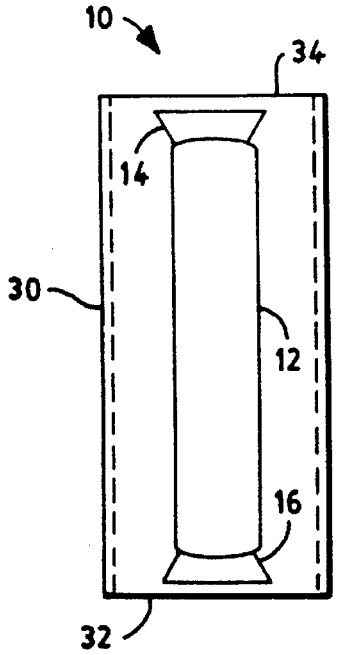
FIG. 5 (PRIOR ART)
FIG. 5 schematically illustrates an embodiment of the prior art.

FIG. 5 schematically illustrates a shrouded arc tube assembly of the prior art in which arc tube 10 is coaxially surrounded by a hollow cylindrical fused quartz shroud 30, open at both ends 32 and 34, which reradiates heat emitted by the arc tube back to the arc tube along the longitudinal axis of the shroud. This insures that the bottom portion of the arc tube will remain cooler than the top portion and that, therefore, the surface of the arc tube will not operate isothermally.

Figure 6:
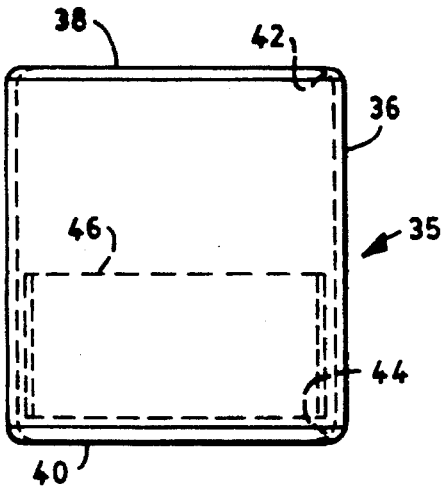
FIGS. 6 and 7 schematically illustrate two different embodiments of the invention.
Figure 7:
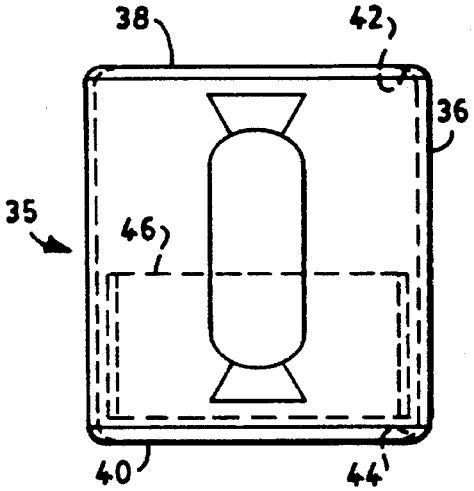

Referring now to FIG. 6, there is schematically shown a shroud 35 as a composite member of a hollow, cylindrical, fused quartz tube member 36 open at both ends, top 38 and bottom 40, which are slightly turned in to provide interior shoulders 42 and 44 for retaining slidable sleeve 46 within. Sliding member 46 is also a hollow cylinder made of fused quartz and open at both ends and having an outer diameter slightly smaller than the inner diameter of cylinder 36, so that it can slide rectilinearly from the top to the bottom of cylinder 36. FIG. 7 schematically illustrates metal halide arc tube 10 in a vertical operating position and coaxially surrounded by shroud 35. In this embodiment the longitudinal axes of the arc tube, cylinder 36 and sleeve 46 are all coincident as shown. Sliding member 46 rests on interior shoulder 44 of cylinder 36 due to gravity. This structure provides a greater distance between the exterior wall surface of arc tube 10 to the interior wall surface of cylinder 36 than the distance between the arc tube and interior wall surface of sliding member 46. The advantage of this embodiment is that it doesn't matter which end of arc tube 30 is up. Irrespective of whether end 38 or 40 is the upper end, slidable sleeve 46 will be positioned around the lower portion of the arc tube. This means that the same lamp can be screwed or otherwise inserted either base up or base down into a lamp socket and still have the distance from the arc tube to the shroud smaller at the cooler bottom portion of the arc tube than the distance from the hotter top portion of the arc tube to the shroud. This design thus insures a more nearly isothermal operation of the arc tube surface irrespective of which end of the lamp (top or bottom) is up. In a variation (not shown) of the embodiment of FIGS. 6 and 7, the position of the siding member at rest with respect to the end of the arc tube is different depending on which end is up. This is accomplished in a variety of ways. For example, in one method the tube member is longer than the arc tube so that one end of the tube member is proximate one end of the arc tube (as illustrated in FIG. 7). With the lamp operated base up, the other end of both the tube member and the slide member extend past the bottom end of the arc tube (which was the top end in the base down operating position) so that less of the arc tube is surrounded by the sliding member. This provides two different operating conditions at the bottom of the arc tube and consequently two different arc tube surface temperature distributions. The arc tube surface temperature has a strong effect on the light spectra emitted by the arc tube, independent (largely) of the isothermality of the arc tube surface. Basically, the two different stops or positions allow two different operating conditions to be realized with the same arc tube, depending on which end of the arc tube is up and which end is down. As a result, one obtains two different color temperatures and lumen outputs for the same lamp. Other variations and means can be used to achieve the two different positions.

Figure 8:
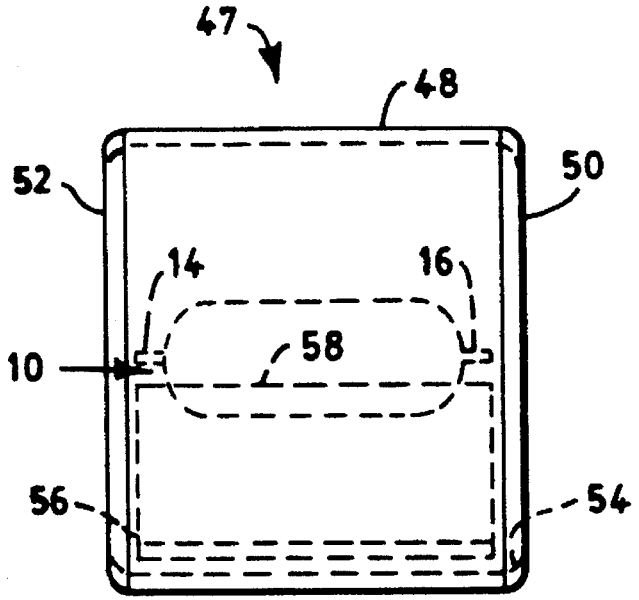
FIGS. 8 and 9 schematically illustrate additional embodiments of the invention.
Figure 9:
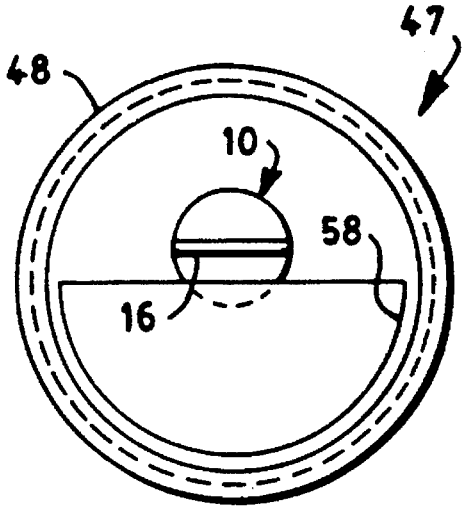

FIGS. 8 and 9 schematically illustrate a side and an end view, respectively, of arc tube 10 in a horizontal position enclosed within a coaxial, hollow cylindrical shroud 47. Shroud 47 includes a hollow, cylindrical, fused quartz tube or outer member 48 having turned in ends 50 and 52 for retaining sliding member 58 within. Member 58 is a section of a hollow cylinder having an outer radius slightly smaller than that of the inner radius of outer member 48 and is also made of fused quartz. As illustrated in the FIGS. 8 and 9, the longitudinal axis of arc tube 10, cylindrical member 48 and member 58 are concentric, although the longitudinal axis of the arc tube need not be concentric with that of the shroud. In use, as a lamp containing a shroud of this embodiment is screwed or otherwise inserted into a corresponding lamp socket, gravity assures that member 58 will slide in a rotational manner so that it will always be at the lowermost position as shown in the figures. This insures that more heat is reflected to the cooler, lower portions of the arc tube surface than to the upper, warmer portions, due to the greater distance from the outer surface of the upper arc tube to the interior shroud surface, and the smaller distance from the bottom surface of the arc tube to the interior surface of member 58, thereby resulting in more nearly isothermal operation of the arc tube surface and lamp than would occur without the shroud or with a shroud of the prior art.

With respect to horizontal operation of an arc tube, a shroud according to an embodiment of the invention, could have an elliptical or oblong cross section about its longitudinal axis, like a cylinder slightly flattened along its surface in a direction parallel to its longitudinal axis. In another embodiment, a cylindrical shroud may be used in which its longitudinal axis is parallel to, but elevated above, the longitudinal axis of the arc tube to place the bottom interior surface of the shroud closer to the bottom exterior surface of the arc tube than the distance between both members at their upper respective surfaces. Still further, a horizontal shroud in the general shape of a hollow cylinder (or other suitable shape) may be employed with a horizontal arc tube with a uniform or nonuniform longitudinal section of the upper portion of the cylinder removed so that less or no heat is radiated back to the uppermost surface of the arc tube.

Figure 10:
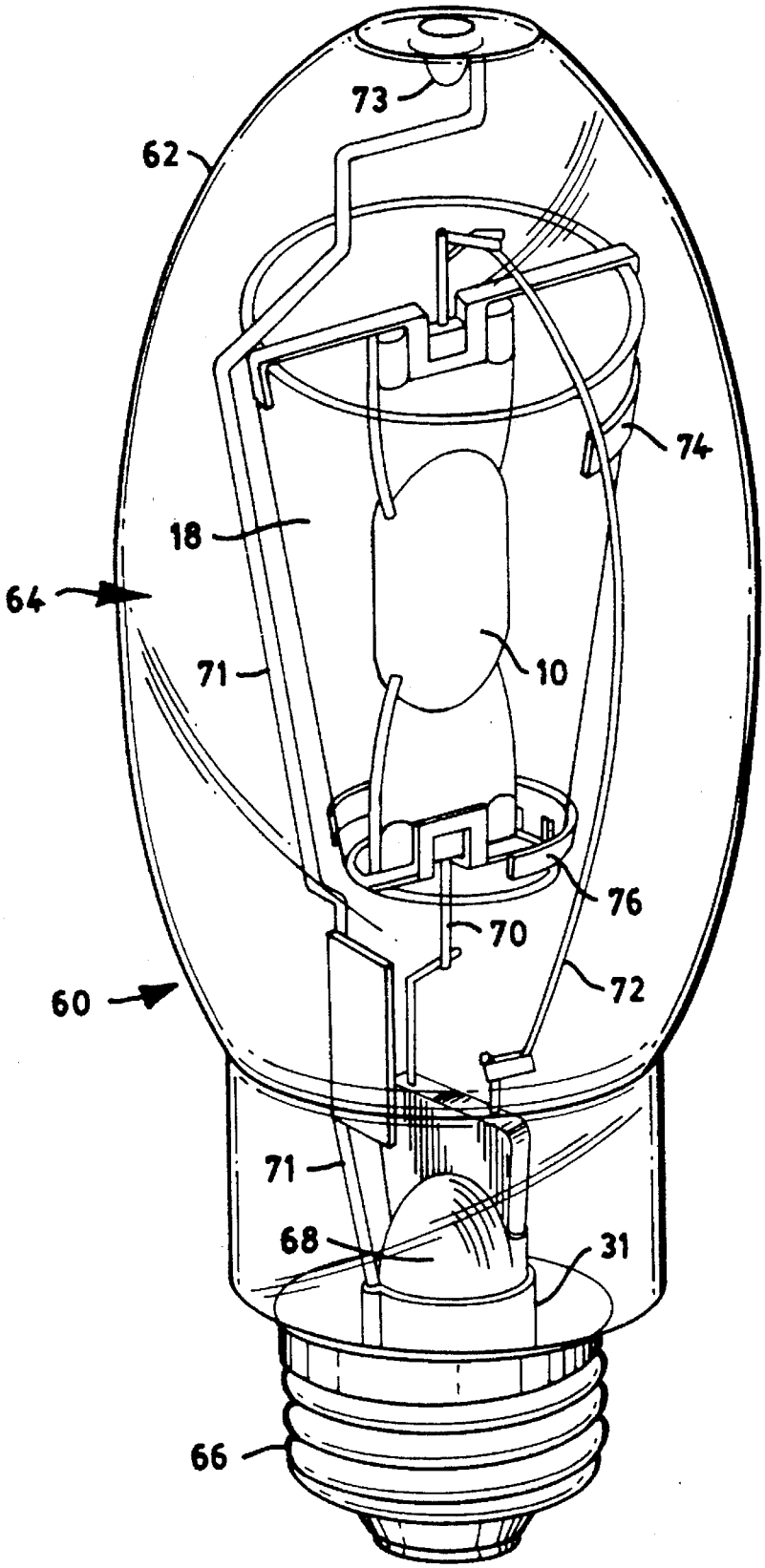
FIG. 10 illustrates, in partial perspective, a high intensity metal halide arc discharge lamp according to an aspect of the invention.

FIG. 10 is a perspective view of a metal halide lamp which is operated in a base down position in which the arc tube is vertical and is surrounded by a fused quartz shroud 18. The lamp 60 includes an outer, vitreous envelope 62 in which is hermetically sealed, metal halide arc tube 10 mounted in lamp envelope 62 by a mounting means 64 according to U.S. Pat. No. 5,252,885 assigned to the assignee of the present invention and to be described in greater detail hereinafter. The arc tube 10 is coaxially positioned within the shroud 18. The shroud is supported in the lamp assembly 60 by the mounting means 64. Electrical energy is coupled to arc tube 10 through a base 66, a stem 68 and electrical leads 70 and 72. Outer envelope 62 is typically formed from blow-molded hard glass. The mounting means 64 mechanically supports both the arc tube 10 and the shroud 18 within the lamp envelope 62. The mounting means 64 secures the arc tube 10 and shroud 18 in fixed positions so that they cannot move axially or laterally relative to the remainder of the assembly of the lamp during shipping and handling or during operation. The mounting means 64 includes a metal support rod 71 attached to stem 68 by a strap 31 and attached to a dimple 73 in the upper end of the lamp envelope 62. The mounting means further includes an upper clip 74 and a lower clip 76 which secure both the arc tube and the shroud to support rod 71.

The invention will be further understood by reference to the examples below.

EXAMPLES

Example 1

Figure 11:
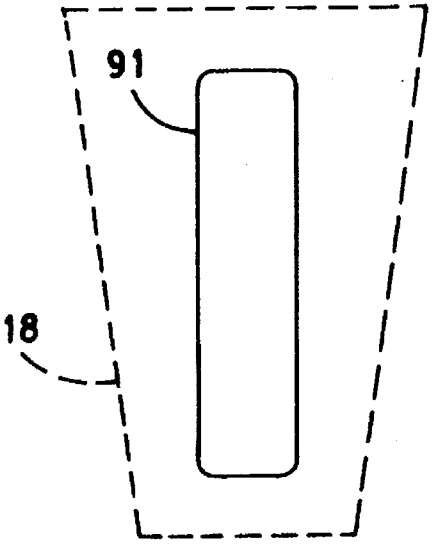

A metal halide high intensity arc discharge lamp having a rating of 100 watts was used and was similar in construction to the lamp illustrated in FIG. 10. The arc tube was one and seven eighths inches long including press seals and having a ½ inch outer diameter, made of fused quartz, with an electrode spacing of 1.4 cm and a chemical fill including iodides of sodium and scandium, along with argon and mercury. The arc tube was concentrically surrounded by a high purity fused quartz shroud in the form of a frustum of a cone two inches long, as illustrated in FIG. 1. The shroud walls were 1.5 mm thick, with the upper and lower openings being 1½ inches and ⅝ inches in diameter, respectively. The arc discharge 91 was observed to be nearly uniformly thick along its entire length, thus proving the more nearly isothermal operation benefit of operating with a shroud according to the invention. A schematic representation of the arc discharge is illustrated in FIG. 11, which shows a slight pinch or constriction in the arc diameter at the bottom.

Comparative Example A

Figure 12:
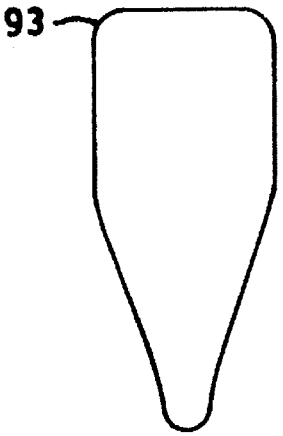

A lamp otherwise identical to that of Example 1 was operated with no shroud. The arc discharge 93 was observed to be of uneven thickness along its longitudinal axis, looking somewhat like an upside down pear in shape. It was wide at the top and relatively narrow at the bottom as generally illustrated in FIG. 12.

Comparative Example B

Figure 13:
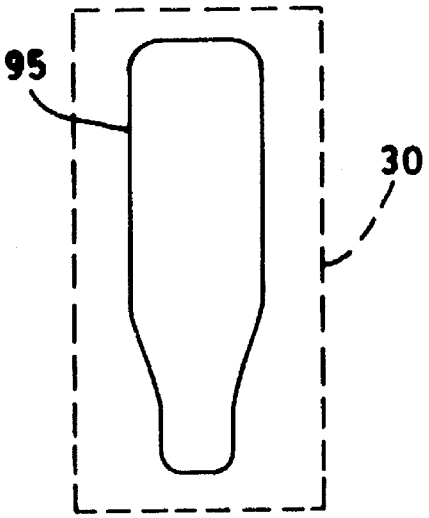
FIGS. 11–13 schematically illustrate the shape of the arc discharge in a high intensity, metal halide arc discharge lamp in which the arc tube is surrounded by a frustoconical shroud, no shroud and a cylindrical shroud of the prior art, respectively.

In this experiment a lamp identical to that of Example 1 was used, except that it was operated with a shroud of the prior art which was a cylindrical quartz tube one inch in diameter (ID) with 1.5 mm thick walls. The arc discharge was observed to have a shape generally in-between that of Examnple 1(FIG. 11) and Comparative Example A (FIG. 12). This arc discharge 95 is generally illustrated in FIG. 13.

It is understood that various other embodiments and modifications in the practice of the invention will be apparent to, and can be readily made by, those skilled in the art without departing from the scope and spirit of the invention described above.

Accordingly, it is not intended that the scope of the claims appended hereto be limited to the exact description set forth above, but rather that the claims be construed as encompassing all of the features of patentable novelty which reside in the present invention, including all the features and embodiments which would be treated as equivalents thereof by those skilled in the art to which the invention pertains.

What is claimed is:

1. A high intensity arc discharge lamp comprising a heat and light emitting arc discharge tube enclosed within a vitreous outer lamp envelope and means for coupling electrical energy to said arc discharge tube, wherein one portion of said arc tube surface is cooler than other portions of said surface and wherein at least a portion of said arc tube is surrounded by a heat absorbing and light transmitting shroud positioned closer to said cooler portion of said arc tube surface for absorbing heat emitted by said arc tube and transmitting more of said absorbed heat back to said cooler arc tube surface than to said other portions, thereby providing a more nearly isothermal arc tube surface than there would be if the distance between said shroud and all portions of said arc discharge tube was uniform.

2. A lamp according to claim 1 wherein said arc tube has a top and a bottom and said top of said arc tube is hotter than said bottom.

3. A lamp according to claim 1 wherein said shroud includes an outer member containing a sliding member within, both of which are spaced apart from said arc tube, with said sliding member closer to said arc tube than said outer member and wherein said sliding member moves in said outer member under the force of gravity to always be positioned proximate said cooler portion of said arc tube.

4. A lamp according to claim 1 wherein said shroud contains means for changing the surface temperature of said arc tube depending on said arc tube orientation.

5. A lamp according to claim 3 wherein said outer member comprises a hollow cylinder.

6. A lamp according to claim 1 wherein said shroud is in the shape of a hollow frustum of a cone.

7. A lamp according to claim 1 wherein said shroud is shaped like a hollow bell.

8. A lamp according to claim 1 wherein said shroud is hollow with an undulating surface of revolution.

* * * * *